US009383065B1

(12) United States Patent
Cady et al.

(10) Patent No.: US 9,383,065 B1
(45) Date of Patent: Jul. 5, 2016

(54) UNDERWATER CRYOGENIC STORAGE VESSEL AND METHOD OF USING THE SAME

(71) Applicant: The Boeing Company, Chicago, IL (US)

(72) Inventors: Edwin C. Cady, Tustin, CA (US); Daniel A. Watts, Surfside, CA (US); Gary D. Grayson, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 120 days.

(21) Appl. No.: 14/162,188

(22) Filed: Jan. 23, 2014

Related U.S. Application Data

(62) Division of application No. 12/552,130, filed on Sep. 1, 2009, now Pat. No. 8,651,313.

(51) Int. Cl.

| | |
|---|---|
| ***F17D 3/01*** | (2006.01) |
| ***F17C 3/10*** | (2006.01) |
| ***F17C 6/00*** | (2006.01) |
| ***F17C 13/08*** | (2006.01) |

(52) U.S. Cl.
CPC ... *F17D 3/01* (2013.01); *F17C 3/10* (2013.01); *F17C 6/00* (2013.01); *F17C 13/082* (2013.01); *F17C 2205/0149* (2013.01); *F17C 2270/0131* (2013.01)

(58) Field of Classification Search
CPC ..... F17C 3/025; F17C 3/10; F17C 6/00; F17C 13/045; F17C 13/082; F17C 2203/0629; F17C 2205/0149; F17C 2270/0131
See application file for complete search history.

(56) References Cited

U.S. PATENT DOCUMENTS

| | | | | |
|---|---|---|---|---|
| 662,217 | A | 11/1900 | Brady | |
| 1,485,665 | A | 3/1924 | Botner | |
| 2,900,800 | A | 8/1959 | Loveday | |
| 3,030,780 | A * | 4/1962 | Loveday | F17C 3/08 220/560.13 |

(Continued)

FOREIGN PATENT DOCUMENTS

| | | |
|---|---|---|
| JP | 2004214169 | 7/2004 |
| WO | WO 2008/061345 | 5/2008 |

OTHER PUBLICATIONS

Angela Psoma, "Fuel cell systems for submarines: from the first idea to serial production", 2002, Elsevier, 381-383.*

(Continued)

*Primary Examiner* — Mohammad M Ali
*Assistant Examiner* — Christopher R Zerphey
(74) *Attorney, Agent, or Firm* — Baldauff IP, LLC; Michael J. Baldauff, Jr.

(57) ABSTRACT

Technologies are described herein for storing fluid in an underwater cryogenic storage vessel designed for use in a fuel system of an underwater vehicle. According to one aspect of the disclosure, a storage vessel includes at least two concentrically arranged storage tanks, which includes a first storage tank and a second storage tank. The first storage tank surrounds the second storage tank, such that the first storage tank is configured to protect the second storage tank from external environmental conditions. The storage vessel also includes a storage compartment positioned adjacent to the two storage tanks. In one embodiment, the storage vessel may be an underwater cryogenic storage vessel that stores liquid oxygen used as a reactant in a fuel cell and liquid carbon dioxide, which is an effluent of the fuel cell.

12 Claims, 3 Drawing Sheets

(56) References Cited

U.S. PATENT DOCUMENTS

| | | | | |
|---|---|---|---|---|
| 3,069,045 | A | 12/1962 | Wilfried et al. | |
| 3,282,459 | A * | 11/1966 | Wilson | B01J 3/04 220/585 |
| 3,514,006 | A | 5/1970 | Molnar | |
| 4,120,421 | A | 10/1978 | Prost | |
| 4,287,720 | A | 9/1981 | Barthel | |
| 4,337,624 | A | 7/1982 | Hamon | |
| 4,751,151 | A * | 6/1988 | Healy | B01D 53/62 429/410 |
| 4,767,593 | A | 8/1988 | Wedellsborg | |
| 4,807,833 | A | 2/1989 | Pori | |
| 5,005,362 | A * | 4/1991 | Weltmer, Jr. | F17C 3/08 62/45.1 |
| 5,375,423 | A | 12/1994 | Delatte | |
| 6,128,908 | A | 10/2000 | Gustafson | |
| 6,314,978 | B1 * | 11/2001 | Lanning | B64G 1/402 137/1 |
| 6,708,502 | B1 | 3/2004 | Aceves et al. | |
| 7,568,352 | B2 | 8/2009 | Grayson et al. | |
| 7,850,034 | B2 | 12/2010 | Munshi et al. | |
| 8,100,284 | B2 | 1/2012 | Schlag et al. | |
| 8,651,313 | B1 * | 2/2014 | Cady | F17C 3/08 220/560.07 |
| 8,859,153 | B1 * | 10/2014 | Cady | H01M 8/0668 429/408 |
| 2002/0008111 | A1 | 1/2002 | Pelloux-Gervais et al. | |
| 2007/0264543 | A1 * | 11/2007 | Kim | C01B 3/384 429/412 |
| 2007/0289975 | A1 * | 12/2007 | Schmehl | F17C 1/00 220/582 |

OTHER PUBLICATIONS

AIAA Paper 2006-7454, The Advanced Cryogenic Evolved Stage (ACES), by J. F. LeBar and E. C. Cady, Sep. 2006, 6 pages.

AIAA Paper 90/3533, Extended Duration Orbiter presented @ the AIAA Space Programs and Technologies Conference, Sep. 25-28, 1990 / Huntsville, AL by D. Germany, 6 pages.

IEEE Journal of Oceanic Engineering, vol. 32, No. 2, Apr. 2007, pp. 365-372. Entitled: "Unmanned Underwater Vehicle Fuel Cell Energy/Power System Technology Assessment", by Kevin L. Davies and Robert M. Moore.

U.S. Office Action dated Aug. 14, 2012 in U.S. Appl. No. 12/552,130.

U.S. Office Action dated Jan. 22, 2013 in U.S. Appl. No. 12/552,130.

Notice of Allowance dated Sep. 16, 2013 in U.S. Appl. No. 12/552,130.

U.S. Office Action dated Feb. 4, 2013 in U.S. Appl. No. 12/552,136.

U.S. Office Action dated Sep. 27, 2013 in U.S. Appl. No. 12/552,136.

Notice of Allowance dated May 29, 2014 in U.S. Appl. No. 12/552,136.

* cited by examiner

UNDERWATER CRYOGENIC STORAGE VESSEL AND METHOD OF USING THE SAME

CROSS-REFERENCE OF RELATED APPLICATIONS

This application is a division of co-pending U.S. patent application Ser. No. 12/552,130, filed on Sep. 1, 2009, entitled UNDERWATER CRYOGENIC STORAGE VESSEL, which is related to U.S. patent application Ser. No. 12/552,136, filed on Sep. 1, 2009, and entitled THERMAL CONDITIONING FLUIDS FOR AN UNDERWATER CRYOGENIC STORAGE VESSEL, each of which is expressly incorporated by reference in its entirety.

GOVERNMENT RIGHTS

This invention was made with Government support under contract number HR0011-06-C-0073 awarded by the United States Navy. The government has certain rights in this invention.

FIELD OF THE DISCLOSURE

The present disclosure relates generally to storing liquids, and in particular, to the supply and collection of liquids with a storage vessel.

BACKGROUND

Some vehicles, such as underwater vehicles, have a fuel system that uses a fuel cell to provide power to the vehicle. Typically, these fuel cells are supplied with kerosene and oxygen to produce power. These fuel cells also produce carbon dioxide as an effluent. In such power systems, the oxygen supplied to the fuel cell is stored in storage tanks, which are connected to the fuel cell. The resulting carbon dioxide is collected and stored in separate storage tanks.

In existing power systems of such vehicles, the oxygen is stored as a liquid in storage tanks arranged adjacent to each other. Before supplying the oxygen to the fuel cell, the liquid oxygen in these tanks may need to be boiled off, such that the oxygen supplied to the fuel cell is in a gaseous state. However, the heat supplied to one of the tanks for boiling off the oxygen may dissipate to the other tanks in the vicinity, thereby increasing the temperature and consequently, the pressure in the storage tanks adjacent to the tank that is being supplied with heat.

In an attempt to reduce the effect of the dissipated heat on the other tanks located in the vicinity, the tanks are conventionally made with insulated vacuum gaps to reduce the amount of heat that may leak into the unused tanks. However, because of the insulated gaps, these tanks take up a larger volume. Further, because there may still be some heat leak into the storage tanks despite the insulated gaps around the storage tanks, the fluids in the tanks may expand due to an increase in pressure. In order to account for the possibility of fluid expansion, these conventional tanks are typically only partially-filled, thereby requiring tanks with greater volume to store the amount of fuel desired.

It is with respect to these and other considerations that the disclosure made herein is presented.

SUMMARY

Technologies are described herein for storing fluid in storage vessel that may be utilized as part of a fuel system for an underwater vehicle. According to one aspect of the disclosure, a storage vessel includes at least two concentrically arranged storage tanks, which includes a first storage tank and a second storage tank. The first storage tank surrounds the second storage tank, such that the first storage tank is configured to protect the second storage tank from external environmental conditions. The storage vessel also includes a storage compartment positioned adjacent to the at least two storage tanks.

In another aspect of the present disclosure, a method for protecting fluids stored in a storage vessel from external environmental conditions includes storing a first fluid in a first storage tank and storing a second fluid in a second storage tank. The first storage tank and the second storage tank are concentrically arranged, such that the first storage tank surrounds the second storage tank. The method also includes insulating the first storage tank and the second storage tank from external environmental conditions.

In yet another aspect, an underwater cryogenic storage vessel includes at least two concentrically arranged storage tanks, The storage tanks include a first storage tank and a second storage tank that are configured to store a fluid. The first storage tank surrounds the second storage tank, such that the first storage tank protects the second storage tank from external environmental conditions. A storage compartment is positioned adjacent to the two storage tanks and is configured to store an effluent.

It should be appreciated that the above-described subject matter may also be implemented in various other embodiments without departing from the spirit of the disclosure. These and various other features will be apparent from a reading of the following Detailed Description and a review of the associated drawings.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
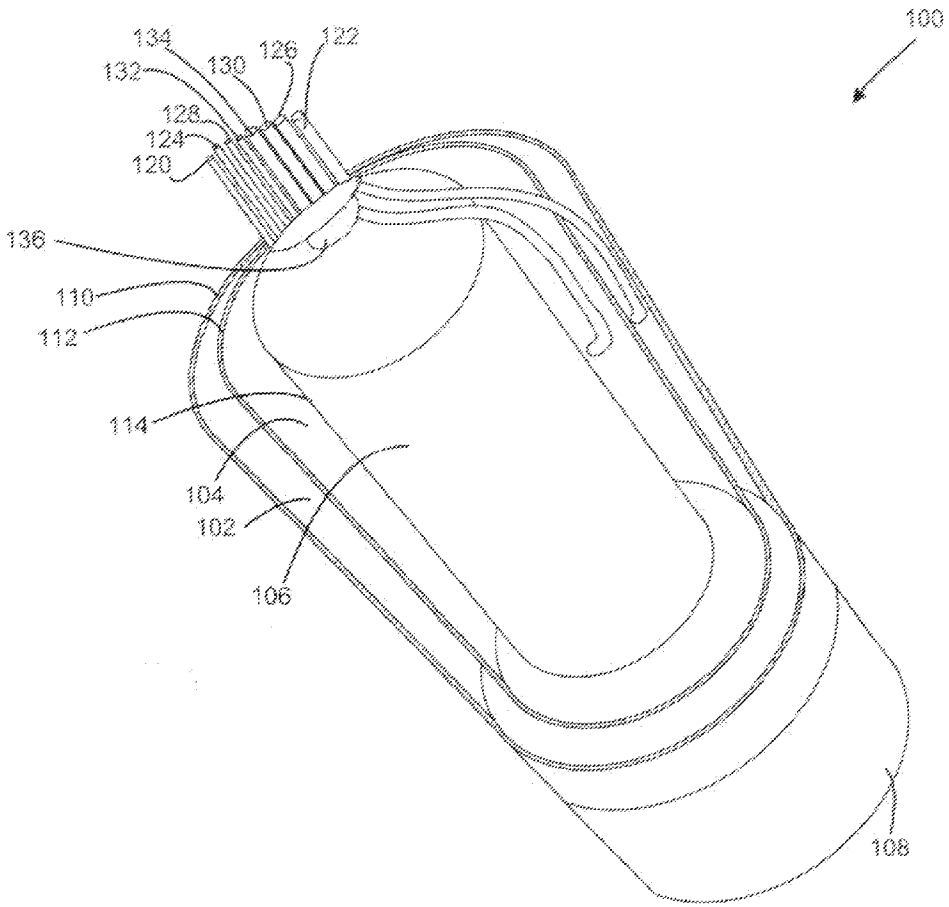
FIG. 1 is a cut-open view of a storage vessel, according to embodiments described herein.

The following detailed description is directed to technologies for a storage vessel that may be configured to supply a first fluid and to store a second fluid as the first fluid is being supplied. In the following detailed description, references are made to the accompanying drawings that form a part hereof, and which are shown by way of illustration, specific embodiments, or examples. Referring now to the drawings, in which like numerals represent like elements through the several figures, a storage vessel according to the various embodiments will be described. As described above, the storage vessel may be utilized to store liquid fuel in an underwater cryogenic storage vessel designed for a fuel system of an underwater vehicle.

Figure 2:
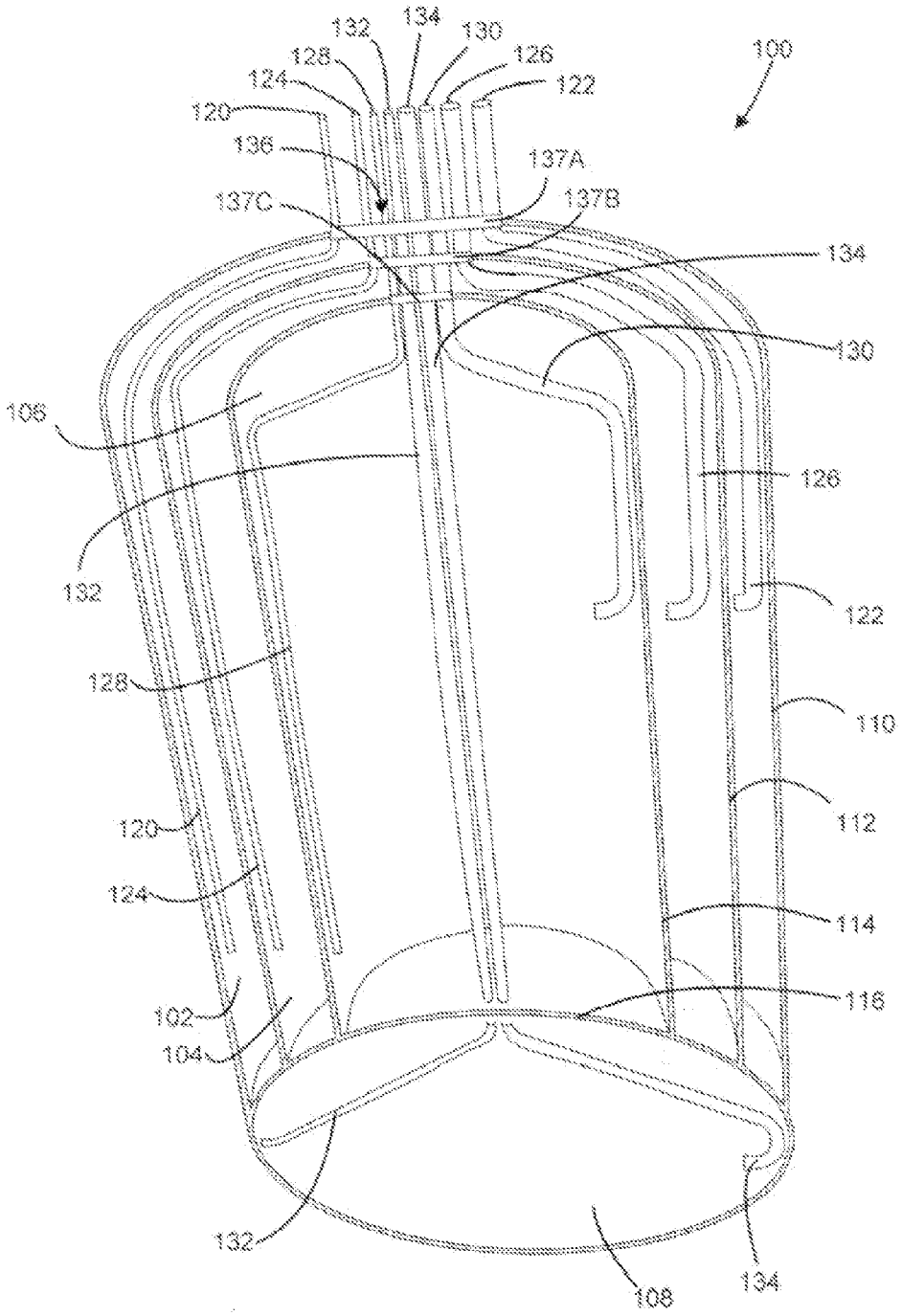
FIG. 2 is a partial cut-open view and partial bottom view of the storage vessel, according to embodiments described herein.

Referring to FIGS. 1 and 2, a storage vessel 100 is shown that includes storage tanks 102, 104, 106 and a storage compartment 108 that is positioned adjacent to one end of the storage tanks 102, 104, 106. It should be appreciated that the storage vessel 100 may include any number of storage tanks and any number of storage compartments within the storage vessel 100. In one embodiment, the storage vessel 100 may not include even one storage compartment. In embodiments where there is more than one storage compartment, the storage compartments may also be arranged concentrically or in any other fashion.

In the present embodiment, the storage vessel 100 includes the first storage tank 102, the second storage tank 104 and the third storage tank 106 concentrically arranged such that the first storage tank 102 is surrounding the second storage tank 104, and the second storage tank 104 is surrounding the third storage tank 106. The first storage tank 102 may include a first fluid entry port 120 and a first fluid exit port 122. The second storage tank 104 may include a second fluid entry port 124 and a second fluid exit port 126, and the third storage tank 106 may include a third fluid entry port 128 and a third fluid exit port 130. In addition, the storage compartment 108 may also include a compartment fluid entry port 132 and a compartment fluid exit port 134. Details of the fluid entry ports 120, 124, 128, 132 and fluid exit ports 122, 126, 130, 134 will be described in detail below in regard to FIG. 2.

In various embodiments, the third storage tank 106 may be nested inside the second storage tank 104, which may be nested inside the first storage tank 102. Each of the first, second, and third storage tanks 102, 104, 106 have a bottom end, which is adjacent the storage compartment 108. In some embodiments, each of the three storage tanks 102, 104, 106 and the storage compartment 108 may contain the same volume of fluid or may contain different volumes of fluid.

According to various embodiments, the storage vessel 100 may store one fluid or more than one fluid. In some embodiments, the first storage tank 102 may store a first fluid, the second storage tank 104 may store a second fluid, and the third storage tank 106 may store a third fluid. Further, the storage compartment 108 may be used to store the same or a different fluid as the storage tanks. In some embodiments, the three storage tanks 102, 104, 106 and the storage compartment 108 are sealed, such that the fluid from one of the storage tanks 102, 104, 106 and the storage compartment 108 may not flow into another storage tank 102, 104, 106 or the storage compartment 108.

In the present embodiment, the storage vessel 100 may be utilized for storing a first fluid that may be used as a reactant in a fuel cell 302 (shown in FIG. 3) and a second fluid that may be a byproduct produced by the fuel cell 302. In a specific embodiment, the first fluid may be liquid oxygen, while the second fluid may be liquid carbon dioxide. Because of the very low boiling points of these liquids, it is important that the storage tanks 102, 104, 106 storing these liquids maintain low temperatures, such that the liquids do not boil off to gas and thereby increase the pressure inside these tanks 102, 104, 106. Therefore, it may be desirable to protect the storage tanks 102, 104, 106 from external environmental conditions by covering them with insulating materials and/or a vacuum gap. The vacuum gap may be a gap between two storage tanks that is a vacuum. The vacuum gap may serve as an insulator, such that the amount of heat exchange between the two storage tanks is reduced.

External environmental conditions may include conditions that exist outside each storage tank 102, 104, 106. Specifically, these external environmental conditions may include environmental conditions, such as the temperature, pressure, and illumination of the environment around the storage tanks 102, 104, 106. In some embodiments, the storage vessel 100 may be used to store cryogenic liquids, such as liquid oxygen, which has a boiling point of around −290° F. and liquid carbon dioxide, which has a boiling point of around −60° F. Therefore, if the storage vessel 100 is placed in normal environmental conditions, for example, at 45° F., the temperature inside the storage vessel 100 is significantly lower than the environmental conditions external to the storage vessel 100. Further, because the storage tanks 102, 104, 106 are concentrically arranged, the external conditions of the first storage tank 102 may be influenced by the external environmental conditions, such as the temperature outside the storage vessel 100 on one side, and by the temperature inside the second storage tank 104. It should be appreciated that the conditions external to a particular storage tank 102, 104, 106 or storage compartment 108 may influence the conditions inside the storage tank 102, 104, 106 or storage compartment 108. According to embodiments, the storage vessel 100 may utilize insulating material such as multi-layer insulation in a vacuum gap or evacuated powder insulation or foam insulation to protect the storage vessel 100 from external environmental conditions.

Further, in embodiments, each storage tank 102, 104, 106 may be surrounded by insulating material to protect each storage tank 102, 104, 106 from external environmental conditions that exist in the remaining storage tanks 102, 104, 106 and storage compartment 108. In some embodiments where space is limited, it may be desirable to utilize a smaller amount of space for insulating the storage tanks 102, 104, 106. Therefore, a thin layer of multi-layer insulation may surround each of the storage tanks 102, 104, 106. By insulating the storage tanks 102, 104, 106, the fluid stored in the storage tanks 102, 104, 106 may be protected from conditions that may be present in the remaining storage tanks 102, 104, 106. In various embodiments, the bottom end of the storage tanks 102, 104, 106 is also surrounded by insulating material, such that the conditions present in the storage compartment 108 may not affect the fluid in the storage tanks 102, 104, 106. In one embodiment, each storage tank 102, 104, 106 may be surrounded by a vacuum jacket, which serves as an insulator for the storage tank it surrounds. Similar to the vacuum gap, the vacuum jacket may surround a storage tank such that a vacuum surrounds the storage tank, which serves as a thermal insulator to reduce the amount of heat exchange between the storage tank and the external environment surrounding the storage tank.

According to embodiments, each storage tank 102, 104, 106 may be surrounded by an insulating material to protect the storage tank from external environmental conditions. Specifically, the first storage tank 102 may be surrounded by a first insulating material 110, which may be configured to protect the first storage tank 102 and the contents inside the first storage tank 102 from the external environmental conditions, such as the temperature inside the first storage tank 102, that may influence the conditions. Similarly, the second storage tank 104 may be surrounded by a second insulating material 112, which may be configured to protect the second storage tank 104 and the contents inside the second storage tank 104 from the external environmental conditions, such as the environmental conditions inside the first storage tank 102, exposed to the surface of the second storage tank 104 and in contact with the second insulating material 112. It should be appreciated that the second insulating material 112 may also protect the first storage tank 102 from the environmental conditions present in the second storage tank 104. The third storage tank 106 may be surrounded by a third insulating material 114, which may be configured to protect the third storage tank 106 and the contents inside the third storage tank 106 from the external environmental conditions exposed to the surface of the third storage tank 104 and in contact with the third insulating material 114. It should further be appreciated that the third insulating material 114 may also protect the second storage tank 104 from the environmental conditions present in the third storage tank 106. Therefore, it may be appreciated that the insulating material may protect each storage tank from the external environmental conditions that surround that particular storage tank. As a result, any change in environmental conditions, such as a change in temperature that occurs in a particular storage tank, may be isolated to that particular storage tank.

In order to maintain the pressure inside the storage vessel 100, and the individual storage tanks 102, 104, 106 and the storage compartment 108, a seal 136 may be placed at the top end of the storage vessel 100. Those skilled in the art may appreciate that the seal 136 may allow the fluid entry ports 120, 124, 128, 132 and fluid exit ports 122, 126, 130, 134 of the three storage tanks 102, 104, 106 and storage compartment 108 to pass through the seal 136, such that there is no leakage present between the ports and the seal 136. It should be appreciated that the seal 136 may be made from a variety of materials that are known to those skilled in the art. It may be desirable to select a seal that may operate under the conditions in which the storage vessel will be utilized. For instance, in embodiments where the storage vessel 100 is being used to store liquid oxygen, a seal that is capable of operating under extremely cold temperatures may be used. Further details regarding the seal 136 will be described below.

Figure 3:
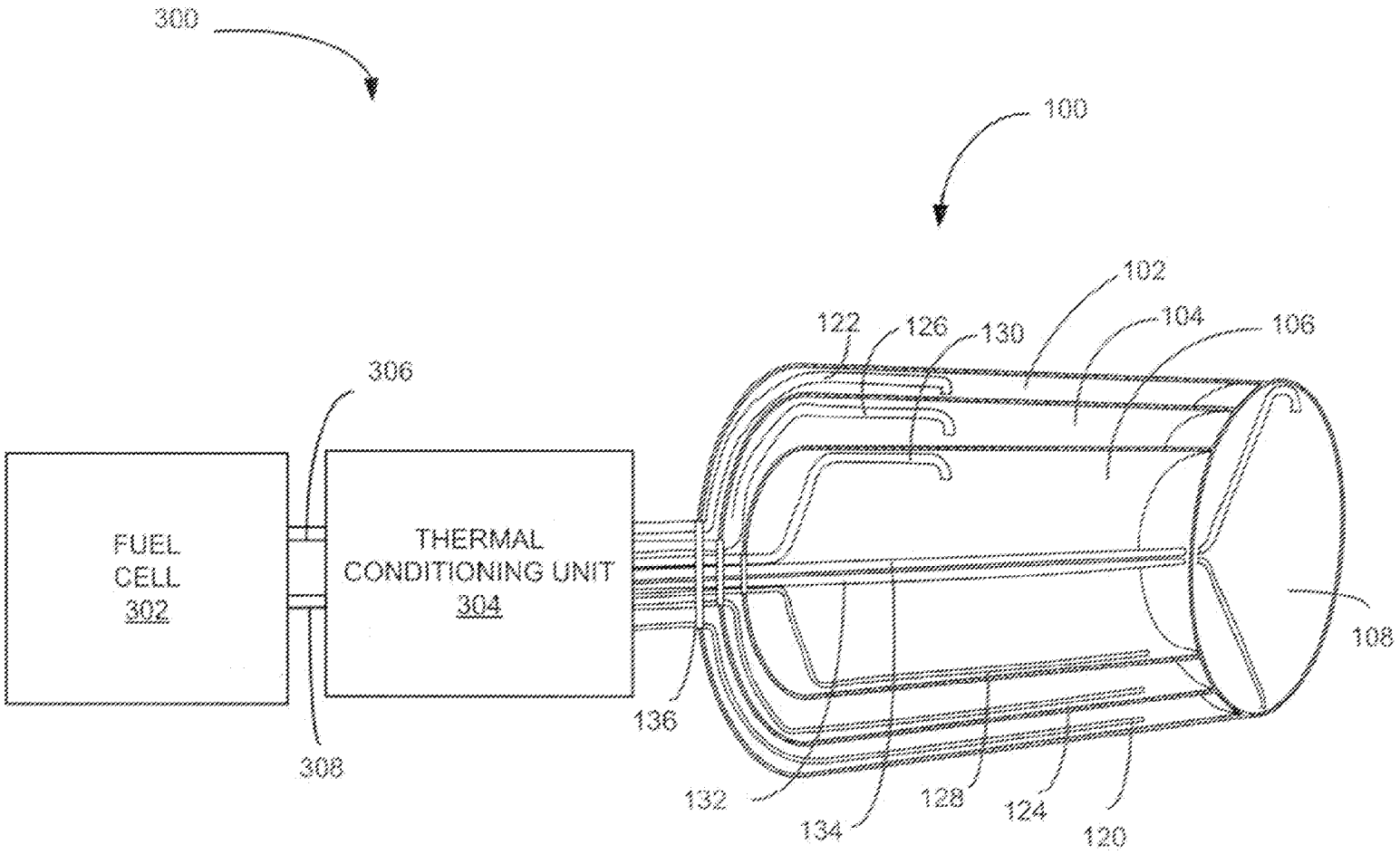
FIG. 3 is a block diagram illustrating a fuel system comprising a fuel cell, a thermal conditioning unit, and the storage vessel, according to embodiments described herein.

Still referring to FIGS. 1 and 2, the storage vessel 100 may include plurality of fluid entry ports 120, 124, 128, 132 and fluid exit ports 122, 126, 130, 134. In various embodiments, the plurality of fluid entry ports 120, 124, 128, 132 and fluid exit ports 122, 126, 130, 134 extend out of the storage vessel 100 at the top end of the storage vessel 100 where they may be attached to a thermal conditioning unit 304 (as shown in FIG. 3) or a fluid source. In various embodiments, the storage vessel 100 and storage compartment 108 may include at least one fluid entry port 120, 124, 128, 132 and at least one fluid exit port 122, 126, 130, 134. According to the present embodiment, each storage tank 102, 104, 106 may include at least one fluid entry port 120, 124, 128, 132 and at least one fluid exit port 122, 126, 130, 134. The first storage tank 102 may include the first fluid entry port 120, which may be used to supply fluid to be stored in the first storage tank 102. The first storage tank 102 may also include the first fluid exit port 122, which may be configured to receive the first storage tank 102. It should be appreciated that the first fluid exit port 122 may be configured to receive vapors of the fluid stored in the first storage tank 102.

Similarly, the second storage tank 104 may include the second fluid entry port 124, which may be used to supply fluid to be stored in the second storage tank 104. The second storage tank 104 may also include the second fluid exit port 126, which may be configured to receive the stored fluid inside the second storage tank 126 and to remove the stored fluid from the second storage tank 104. In addition, the third storage tank 106 may also include the third fluid entry port 128, which may be used to supply fluid to be stored in the third storage tank 106. The third storage tank 106 may also include the third fluid exit port 130, which may be configured to receive the stored fluid inside the third storage tank 106 and to remove the stored fluid from the third storage tank 106.

In various embodiments, the compartment fluid entry port 132 may extend from outside the storage vessel 100, pass through the inner most storage tank, and into the storage compartment 108. In some embodiments, the inner most storage tank is the third storage tank 106. The compartment fluid entry port 132 may be used to supply a fluid to the storage compartment 108. Further, the storage vessel 100 may include the compartment fluid exit port 134, which similar to the compartment fluid entry port 132, may extend from outside the storage vessel 100, pass through the inner most storage tank, to the storage compartment 108. In various embodiments, the fluid passing through the compartment fluid entry port 132 and compartment fluid exit port 134 may be affected by the conditions present inside the inner most storage tank. In order to reduce the effects caused by the conditions present inside the inner most storage tank, the compartment fluid entry port 132 and compartment fluid exit port 134 may be surrounded by insulating material.

As described above, the seal 136 may be configured to receive the fluid entry ports 120, 124, 128, 132 and fluid exit ports 122, 126, 130, 134, while also be configured to maintain the pressure inside each of the storage tanks 102, 104, 106 and the storage compartment 108. The seal 136 may include a first seal 137A configured to maintain the pressure inside the first storage tank 102, a second seal 137B configured to maintain the pressure in the second storage tank 104 and a third seal 137C configured to maintain the pressure in the third storage tank 106.

Referring now to FIG. 3, a fuel system 300 including the fuel cell 302, the thermal conditioning unit 304 and the storage vessel 100 is shown. In one embodiment of the fuel system 300, the fuel cell 302 utilizes gaseous oxygen and kerosene to generate energy and produce gaseous carbon dioxide as an effluent. The storage vessel 100 may be configured to store liquid oxygen that is to be provided to the fuel cell 302 and liquid carbon dioxide that is to be collected from the fuel cell 302. Those skilled in the art may appreciate that the kerosene may be supplied to the fuel cell from a kerosene source (not shown).

According to embodiments, the storage vessel 100 may store liquid oxygen in the three storage tanks 102, 104, 106, and the storage compartment 108 may be empty. In one embodiment, the storage compartment 108 may store gaseous oxygen. The thermal conditioning unit 304 may include a plurality of valves (not shown) that control the supply of cold oxygen from the storage vessel 100 through the various ports of the storage vessel 100. According to some embodiments, the thermal conditioning unit 304 may open a valve controlling the flow of fluids through the first fluid exit port 122, such that the cold oxygen from the first storage tank 102 may be supplied to the thermal conditioning unit 304, which is configured to convert the cold oxygen to warm oxygen gas prior to supplying it to the fuel cell 302 via passage 306. Upon receiving the gaseous oxygen from the thermal conditioning unit 304, the fuel cell 302 generates energy and produces gaseous carbon dioxide as an effluent. The gaseous carbon dioxide is then supplied to the thermal conditioning unit 304 via passage 308, where the gaseous carbon dioxide is conditioned into liquid carbon dioxide. The thermal conditioning unit 304 may open a valve controlling the flow of fluids through the compartment entry port 132, such that the liquid carbon dioxide received from the fuel cell 302 and conditioned by the thermal conditioning unit 304 is supplied to the storage compartment 108 of the storage vessel 100.

In various embodiments, once the first storage tank 102 contains no or small amounts of liquid oxygen, the thermal conditioning unit 304 may close the valve controlling the flow of fluids through the first fluid exit port 122. The thermal conditioning unit 304 may also open a valve controlling the flow of fluids through the second fluid exit port 126. As the valve for the second fluid exit port 126 is opened, cold oxygen from the second storage tank 104 is supplied to the thermal conditioning unit 304, where the cold oxygen is conditioned such that the thermal conditioning unit 304 converts the cold oxygen to warm gaseous oxygen and supplies it to the fuel cell 302 via the passage 306. According to various embodiments, it may be possible that once the first storage tank 102 is empty and the first storage tank is conditioned to receive liquid carbon dioxide, the thermal conditioning unit 304 may reroute the liquid carbon dioxide to the first storage tank 102 by opening a valve controlling the flow of fluids through the first fluid entry port 120 and routing the liquid carbon dioxide to enter into the first storage tank 102 via the first fluid entry port 120. Similarly, once the second storage tank 104 is empty and the first storage tank 102 is filled with liquid carbon dioxide and the second storage tank 104 is conditioned to receive liquid carbon dioxide, the thermal conditioning unit 304 may route the liquid carbon dioxide to the second storage tank 104. It may be appreciated that because carbon dioxide may not be stored with the oxygen being supplied to the fuel cell, the third storage tank 106 may not be used to store the liquid carbon dioxide at all.

According to various embodiments, the mass, volume and density of the storage vessel 100 may be an important consideration during the construction and application of the storage vessel 100. For instance, in a fuel system for an underwater vehicle, the density of the fuel system and its individual components may be a consideration for maintaining the buoyancy of the vehicle. In such embodiments, the mass of the fluid being stored in the storage tanks 102, 104, 106, the mass of the empty storage vessel 100, and the mass of the fluid being stored in the storage compartment 108 may all be relevant in determining the mass and dimensions of the storage vessel 100. In addition, the material used, the thickness of insulation, and the thickness of the walls of the storage tanks 102, 104, 106 may be considerations that may be taken into account before construction of the storage vessel 100 begins.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A method of supplying and collecting fluids with a storage vessel, the method comprising:

providing at least a first storage tank and a second storage tank concentrically arranged with one another;

providing a storage compartment adjacent to at least the first and second storage tanks;

supplying a first fluid from the first storage tank to a fuel cell;

collecting a second fluid in the storage compartment, the second fluid comprising conditioned effluent from the fuel cell;

emptying the first storage tank of the first fluid; and in response to emptying the first storage tank, collecting the second fluid in the first storage tank.

2. The method of claim 1 further comprising conditioning the first storage tank to receive the second fluid.

3. The method of claim 1 further comprising:

upon having emptied the first fluid from the first storage tank, supplying the first fluid from the second storage tank; and upon emptying the second storage tank of the first fluid and filling the first storage tank with the second fluid, conditioning the second storage tank to receive the second fluid and collecting the second fluid in the second storage tank.

4. The method of claim 3 further comprising thermally conditioning the first fluid supplied from the second storage tank and thermally conditioning the second fluid collected by the second storage tank.

5. The method of claim 3 further comprising providing a third storage tank concentrically arranged with the first and second storage tanks and supplying the first fluid from the third storage tank.

6. The method of claim 1 further comprising thermally conditioning the first fluid supplied from the first storage tank and thermally conditioning the second fluid collected by the storage compartment.

7. The method of claim 1 further comprising thermally conditioning the first fluid supplied from the first storage tank and thermally conditioning the second fluid collected by the first storage tank.

8. The method of claim 1 further comprising thermally conditioning the first fluid supplied from the first storage tank to the fuel cell and thermally conditioning effluent from the fuel cell to create the second fluid and to provide the second fluid to at least one of the storage compartment and the first storage tank.

9. The method of claim 1 further comprising the second fluid passing through the first storage tank to the storage compartment.

10. The method of claim 1 further comprising maintaining the buoyancy of an underwater vehicle with the storage vessel.

11. The method of claim 1 wherein supplying the first fluid comprises supplying liquid oxygen and collecting the second fluid comprises collecting liquid carbon dioxide.

12. A method of supplying and collecting fluids with a storage vessel, the method comprising:

supplying a first fluid from a first storage tank concentrically arranged within a second storage tank to a fuel cell;

collecting a second fluid comprising conditioned effluent from the fuel cell in a storage compartment adjacent to at least the first and second storage tanks, the second fluid different from the first fluid irrespective of pressure;

emptying the first storage tank of the first fluid; and in response to emptying the first storage tank, collecting the second fluid in the first storage tank.

* * * * *